United States Patent [19]

Brugger et al.

[11] 4,008,411

[45] Feb. 15, 1977

[54] PRODUCTION OF 14 MEV NEUTRONS BY HEAVY IONS

[75] Inventors: Robert M. Brugger, Columbia, Mo.; Lowell G. Miller; Robert C. Young, both of Idaho Falls, Idaho

[73] Assignee: The United States of America as represented by the United States Energy Research and Development Administration, Washington, D.C.

[22] Filed: July 8, 1975

[21] Appl. No.: 594,166

[52] U.S. Cl. ..... 313/61 R; 250/500; 313/61 S

[51] Int. Cl.[2] ..... H01J 39/22

[58] Field of Search ..... 313/61 R, 61 S; 250/500, 501

[56] References Cited

UNITED STATES PATENTS

| | | | |
|---|---|---|---|
| 3,715,595 | 2/1973 | Josephson | 313/61 R X |
| 3,786,258 | 1/1974 | Schmidt | 313/61 S X |
| 3,860,827 | 1/1975 | Cranberg | 313/61 S X |

*Primary Examiner*—Rudolph V. Rolinec
*Assistant Examiner*—Lawrence J. Dahl
*Attorney, Agent, or Firm*—Dean E. Carlson; Arthur A. Churm; Robert J. Fisher

[57] ABSTRACT

This invention relates to a neutron generator and a method for the production of 14 MeV neutrons. Heavy ions are accelerated to impinge upon a target mixture of deuterium and tritium to produce recoil atoms of deuterium and tritium. These recoil atoms have a sufficient energy such that they interact with other atoms of tritium or deuterium in the target mixture to produce approximately 14 MeV neutrons.

9 Claims, 2 Drawing Figures

PRODUCTION OF 14 MEV NEUTRONS BY HEAVY IONS

CONTRACTUAL ORIGIN OF THE INVENTION

The invention described herein was made in the course of, or under, a contract with the UNITED STATES ENERGY RESEARCH AND DEVELOPMENT ADMINISTRATION.

BACKGROUND OF THE INVENTION

This invention relates to the generation of high-energy neutrons and is particularly concerned with the generation of high fluxes of 14 MeV neutrons. The invention is concerned with a neutron generator and a method for the production of approximately 14 MeV neutrons to enable the simulation of radiation exposures and damage to structural materials and surfaces which may be encountered in controlled thermonuclear reactor devices.

As research and development efforts progress toward the goal of fusion power reactors and as larger and more advanced experimental CTR (controlled thermonuclear reactor) devices are constructed, engineering and design considerations take on increasing importance. It is believed that overcoming neutron damage, particularly the damage from 14 MeV neutrons generated in a DD or DT reaction will be one of the major engineering problems in designing a controlled thermonuclear reactor. The increasing concern for the engineering and design aspects of CTR's has emphasized the need for information about 14 MeV neutron damage to containment and structural components. While several areas of necessary research have been discussed in more detail in the applicants' recent report "Fission Fragment Driven ($d + t$) Neutron Irradiation Source for CTR Materials Damaged Irradiations," Aerojet Nuclear Company, ANCR-1134 (1974), which report is incorporated herein by reference, two general areas requiring considerable investigation into the effects of 14 MeV neutrons are surface physics and material radiation damage. In order to experimentally determine the extent of damage and to verify theoretical predictions, irradiation facilities that produce about $10^{15}$ neutrons per square centimeter per second of 14 MeV neutrons are needed.

While no source of a high flux of 14 MeV neutrons exists at present, several different proposals for the development of such a source have been prepared. Several variations of the proposed 14 MeV neutron sources accelerate deuterons into tritium targets. However, such sources are limited both by the limits of accelerating beams of particles and by the limits of the target.

It is an object of the present invention to provide a source for high-energy neutrons.

A particular object of the present invention is to provide a neutron generator and method for the production of approximately 14 MeV neutrons.

An additional object of the present invention is to provide a neutron generator for the production of 14 MeV neutrons to permit materials testing by exposing sample materials to neutrons of approximately 14 MeV.

Other objects and advantages of the present invention will become apparent upon reading the following description and with particular reference to a specific embodiment described hereinbelow.

SUMMARY OF THE INVENTION

In accordance with the present invention, approximately 14 MeV neutrons are produced by providing a mixture of deuterium and tritium and accelerating heavy ions to impinge upon the mixture in order to produce recoil deuterons or tritons which interact with other atoms of tritium or deuterium in the mixture to produce approximately 14 MeV neutrons. A neutron generator for production of 14 MeV neutrons employing this method includes a target chamber into which the deuterium-tritium mixture target is introduced and means for accelerating heavy ions, which accelerated ions are introduced into the target chamber so as to impinge upon the mixture to produce recoil deuterons or tritons with the subsequent production of 14 MeV neutrons in accordance with this method. The neutron generator of the present invention is particularly adaptable to producing 14 MeV neutrons by this method wherein the target chamber is adapted to contain a target mixture of deuterium and tritium gas.

BRIEF DESCRIPTION OF THE DRAWINGS

An understanding of the features and advantages offered by the present invention can be obtained from a reading of the following description and with reference to the drawings in which.

DESCRIPTION OF THE INVENTION

Figure 1:
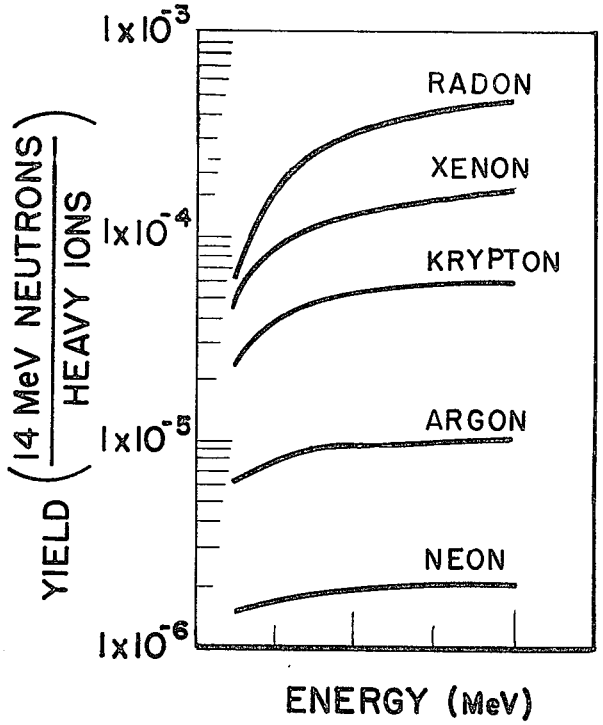
FIG. 1 is a graph showing the yield of 14 MeV neutrons produced by various heavy ions hitting a mixture of deuterium and tritium.

Neutrons of approximately 14 MeV are produced by accelerating heavy ions to impinge upon a mixture of deuterium and tritium. As heavy ions are slowed down in a material, most of the energy is lost through ionization. However, a fraction of the energy loss is due to the heavy ions striking the atoms of the target material causing recoils which have significant quantities of kinetic energy. It has been found that when the slowing down material is a mixture of deuterium and tritium, deuterons and tritons are accelerated, some to energies of keV's, and these recoil atoms have enough energy to interact with other atoms of tritium or deuterium in the mixture to produce 14 MeV neutrons. The chain of reactions commencing with the acceleration of heavy ions (HI) is:

$$\mathrm{HI} + (d \text{ or } t) \rightarrow (d \text{ or } t) \sim_{100\ KeV}$$
$$(d \text{ or } t) \sim_{100\ kev} + (t \text{ or } d) \rightarrow n_{14\ MeV} + {}^4\mathrm{He}$$

Each heavy ion produces a few recoil deuterons or tritons with sufficient energy to produce 14 MeV neutrons by interaction with other tritons or deuterons by the $d\text{-}t \rightarrow {}^4\mathrm{He} + {}_0^1\mathrm{n}$ reaction.

An evaluation of the present method was conducted to determine the number of 14 MeV neutrons produced by a heavy ion based upon the following basic equation:

$$X = N_I n_d n_t k \int_o^{E_o} \frac{dE_1}{\left(\frac{dE}{dx}\right)_t E_1} \int_o^{Q_{max}} \frac{dQ}{Q^2} \int_o^{Q} S_a(E_a) \frac{dE_a}{\left(\frac{dE}{dx}\right)_a}$$

where $k = \pi \left(\frac{e^2}{mc^2}\right)^2 (mc^2)^2 \frac{M_1 Z_1^2 Z_a^2}{M_a} = E_1 Q^2 \frac{dS}{dQ}$ $= 6.5135 \times 10^{-26}$ (MeV . cm)$^2$ $Z_1^2 Z_a^2 M_1/M_a$ and $$Q_{max} = \frac{4M_1 M_a}{(M_1 + M_a)^2} E_1;$$

$n_d$, $n_t$ are atomic densities in nuclei per cm$^3$ of deuterium and tritium, respectively, in the target mixture;

$E_1$ is the energy (variable) of a heavy ion as it slows down in the target material;

$$\left(\frac{dE}{dx}\right)_t, \left(\frac{dE}{dx}\right)_a$$

are the stopping powers respectively for the heavy ions and for the first recoil particle (energy loss per interval of path);

$S_a$ ($E_a$) is the cross section for the reaction $t(d,n)$ $^4$He or $d(t, n)$ $^4$He;

and where: Z is atomic number; e is electron charge; mc$^2$ is the rest energy of an electron; and Q is the initial energy of the recoiling particle. X gives the number of 14 MeV neutrons produced by $N_I$ heavy ions of energy $E_o$, mass $M_1$, charge $eZ_1$, striking particles ($d$ or $t$) of mass $M_a$ and charge $eZ_a$. The expression is to be summed over the cases where the heavy ion strikes an atom of deuterium or an atom of tritium.

Data for cross sections of the $d$-$t$ reactions and the energy loss rates for recoil particles and the heavy ions were taken from the literature. Further discussion of the equation in more detail is contained in the applicants' prior report ANCR-1134 cited above.

A computer evaluation based upon the above equation generated an envelope of curves. The yield rate for heavy ions with energies up to 40 MeV was determined for the noble gas atoms used as the ions since these nicely span the periodic table. These results are presented in FIG. 1 which is a graph of the yield of 14 MeV neutrons per heavy ion striking the deuterium-tritium mixture target as a function of energy of the heavy ion.

As can be seen from the graph of FIG. 1, radon ions of 40 MeV produce about $5 \times 10^{-4}$ 14 MeV neutrons per ion when slowed in a deuterium-tritium mixture. Since this is about five times more neutrons than can be obtained from accelerating the same particle current of 300 keV deuterons into a tritium target, it can be appreciated that the heavy ion reaction can be thought of as a current amplification method. However, the heavy ion source is less efficient by about a factor of 35 when comparing neutrons produced per kilowatt of power on target. A current of 1 mA of single charged radon ions should produce about $3 \times 10^{12}$ 14 MeV neutrons/sec. Currents higher than 1 mA, such as 10 or 100 mA, would generate higher fluxes of neutrons and greater than $10^4$ n/cm-sec. Yields of 14 MeV neutrons from radon ions for several variations in the parameters of a heavy ion source are given in the following table:

YIELD OF 14 MeV NEUTRONS FROM Rn IMPINGING ON d + t MIXTURE

| Current (mA) | Energy of Ion (MeV) | Power on Target (KW) | Yield of 14 MeV (n/sec) | No. $n_{14}$ MeV per Heavy Ion (No./HI) | $n_{14}$ MeV per Power (No./KW) |
|---|---|---|---|---|---|
| 1 | 40 | 40 | $3 \times 10^{12}$ | $5.0 \times 10^{-4}$ | $7.5 \times 10^{10}$ |
| 10 | 40 | 400 | $3 \times 10^{13}$ | $5.0 \times 10^{-4}$ | $7.5 \times 10^{10}$ |
| 100 | 40 | 4000 | $3 \times 10^{14}$ | $5.0 \times 10^{-4}$ | $7.5 \times 10^{10}$ |
| 10 | 20 | 200 | $2 \times 10^{13}$ | $3.3 \times 10^{-4}$ | $7.5 \times 10^{11}$ |
| 10 | 10 | 100 | $1 \times 10^{13}$ | $1.7 \times 10^{-4}$ | $7.5 \times 10^{11}$ |

Figure 2:
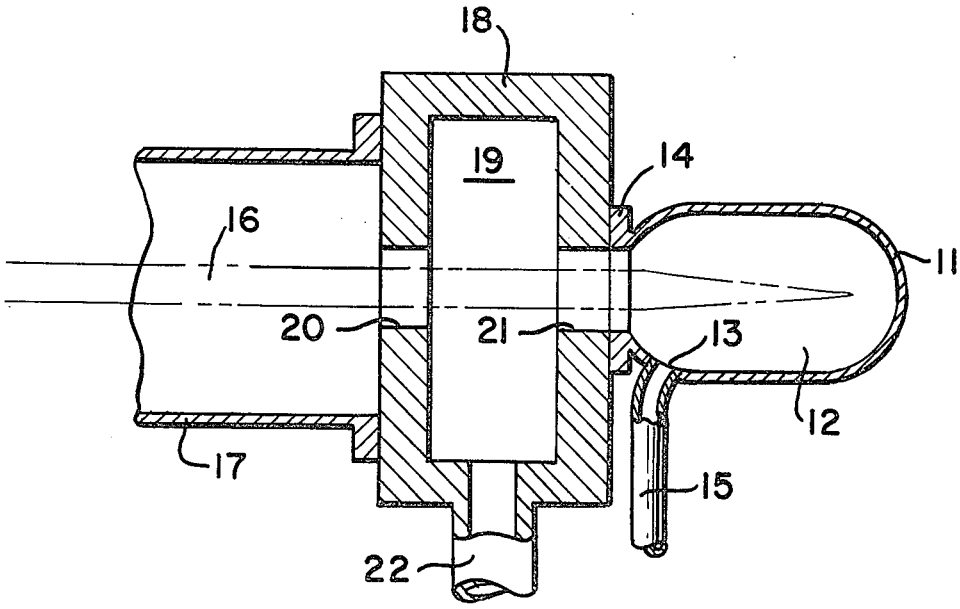
FIG. 2 is a schematic representation of one embodiment of a neutron generator in accordance with the present invention.

Referring now to FIG. 2, there will be described a specific embodiment of the present invention. While the invention is here described in connection with a specific embodiment, it will be understood that it is not intended to limit the invention to only that specific embodiment, but it is intended to cover all alternatives, modifications and equivalents as may be included within the spirit and scope of the invention as defined by the appended claims.

A neutron generator for the production of approximately 14 MeV neutrons employing the present method is shown schematically in FIG. 2. Referring to FIG. 2, there is shown a target housing 11 enclosing a target chamber indicated at 12. The target chamber 11 has an access port 13 and a beam port 14. Means are provided in conjunction with the target chamber 11 for introducing the deuterium-tritium mixture target into the target chamber through the access port 13. While it is possible that the deuterium-tritium mixture target could be in the form of a solid or a liquid, preferably the deuterium-tritium mixture is a gas. While minor variations would be used for the introduction of a solid or liquid target mixture, in accordance with the embodiment shown in FIG. 2, a gaseous mixture target is introduced to the target chamber 12 from an inlet pipe 15 associated with the access port 13. The deuterium-tritium mixture would be pumped by an appropriate pump to the target chamber through the inlet pipe 15 from a reservoir of the target mixture, not shown in FIG. 2. Further, in accordance with the present invention, means are provided for accelerating the heavy ions and introducing the accelerated heavy ions into the target chamber through the beam port 14 so as to impinge upon the target mixture. Means for accelerating heavy ions are well known in the art and readily available. While any of these well-known means are adaptable and can be used in the present invention, a linear heavy ion accelerator is particularly adaptable. As shown in FIG. 2, the heavy ions in the form of heavy ion beam 16 are accelerated in an evacuated beam tube 17. The evacuated beam tube 17 is aligned with the beam port 14 so as permit the accelerated heavy ion beam 16 to enter the target chamber 12 through beam port 14.

In a preferred embodiment, a shroud 18 enclosing a pumping chamber 19 is disposed between and connects the beam tube 17 and the beam port 14. The shroud 18 has collimating slits 20 and 21 aligned with the beam tube 17 and the beam port 14 to permit transmission of the heavy ion beam therethrough. Shroud 18 is also provided with an exhaust port 22. Pumping means such as a vacuum pump, not shown in FIG. 2, are associated with the pumping chamber 19 and communicate therewith through the exhaust port 22. This permits differential pumping of the pumping chamber 19.

In operation, a mixture of deuterium and tritium gas is injected into the target chamber 12 through access port 13. The beam of heavy ions 16 is accelerated to 10–40 MeV such as in the evacuated beam tube 17. The heavy ions pass through the collimating slits 20 and 21 which also serve as restrictions to gas flow from the target chamber, assisting the differential pumping of the pumping chamber 19 through the exhaust port 22. The differential pumping removes target gas that may exit from the target chamber 12 through the beam port 14, the shroud 18 and pumping chamber 19 thereby providing isolation of the evacuated beam tube 17 from the target chamber 12. The heavy ion beam enters the target chamber 12 through the collimating slit 21 and impinges upon the deuterium-tritium mixture. Any heavy ions interacting with any deuterium and tritium escaping from target chamber 12 through the beam port 14 will be diverted very little from the path. The beam divergence of the heavy ion beam will be small. Tighter collimation and limited beam hole size can be employed which limit the differential pumping needed.

While the density of the target gas mixture can be varied, a density of $6 \times 10^{19}$ molecules/cc corresponding to 2 atmospheres of pressure is preferred. The use of a target gas of 2 atmospheres gives the heavy ions a range of about 3 cm. The range of 40 MeV heavy ions is about 6 cm in hydrogen at standard temperature and pressure. It is preferred that the pressure in the chamber be adjusted such that the 40 MeV heavy ions have a range which will stop the heavy ions at the center of the target chamber. The recoiling deuterons and tritons with energies up to 100 keV would have a range of less than 2 mm and thus would not be lost in the wall. Since more of the energetic recoiling deuterons are produced near the end of the range of the heavy ions, more of the 14 MeV neutrons will be produced at the center of the target and not in the regions of the target chamber near the beam port.

While the ratio of deuterium to tritium in the target gas mixture can be varied, it is preferred that the mixture be approximately 50% deuterium-50% tritium.

The beam of heavy ions will transfer power to the target gas, heating and increasing its pressure. For 1 mA at 40 MeV, 400 kw will be transferred to the gas and must be dissipated through the walls of the target chamber. This heat can be removed through external water or liquid metal cooling, radiation, or other cooling means.

The 14 MeV neutron generator of the present invention offers several advantages. The incoming beam of heavy ions will produce a pressure on any escaping gas tending to "close" the beam port of the target chamber and thereby improve containment of the gas. A most important advantage is that the target housing can be constructed of niobium or any other metal to be tested, thus more closely duplicating the CTR reactor and permitting the target housing to act as a material test sample itself. The source can be operated with direct current with a steady state heavy ion beam and adjustment of gas makeup to retain proper density in the target. The source could also be operated pulsed with a pulsed heavy ion accelerator. In this case, inertia would tend to hold the target in the chamber while the beam is impinging. The heated target gas would squirt out after the pulse because of the increased pressure.

Other advantages offered by this heavy ion 14 MeV neutron generator are:

a. it is a particle current amplifier;

b. there is less dispersion of the incoming beam as compared to a deuteron beam;

c. while the heavy ions are at high energy and can enter the target chamber, the recoiling deuterons and tritons are at low energies and will not be lost to the walls of the target housing;

d. more of the neutrons will be produced at the center of the target chamber;

e. the pressure generated by the beam of charged heavy ions will act to close the beam port and hold in the target gas mixture; and f. a mixture of deuterium and tritium is employed such that no isotopic separation is needed and the gas can be recirculated simply.

The embodiments of the invention in which an exclusive property or privilege is claimed are defined as follows:

1. A method for the production of approximately 14 MeV neutrons comprising:

a. providing a mixture of deuterium and tritium;

b. accelerating heavy ions; and c. impinging said accelerated heavy ions onto said mixture to produce recoil deuterons and tritons which interact with atoms of tritium and deuterium in the mixture to produce approximately 14 MeV neutrons.

2. The method of claim 1 wherein said mixture of deuterium and tritium is a gas.

3. The method of claim 2 wherein said gaseous mixture is at a pressure of approximately 2 atmospheres.

4. The method of claim 3 wherein said heavy ions are accelerated to an energy of approximately 40 MeV.

5. The method of claim 3 wherein said mixture is approximately 50% deuterium - 50% tritium.

6. The method of claim 5 wherein said heavy ions are radon ions.

7. A neutron generator for the production of approximately 14 MeV neutrons comprising:

a. a target housing enclosing a target chamber and having therein an access port and a beam port;

b. means for introducing a deuterium-tritium mixture target into said target chamber through said access port;

c. means for accelerating heavy ions; and d. means for introducing said accelerated heavy ions into said target chamber through said beam port so as to impinge upon said mixture to produce recoil deuterons and tritons which interact with atoms of tritium and deuterium in said mixture to produce approximately 14 MeV neutrons.

8. The 14 MeV neutron generator of claim 7 further comprising: a heavy ion beam tube aligned with said beam port so as to direct said accelerated heavy ions through said beam port into said target chamber.

9. The 14 MeV neutron generator of claim 8 further comprising: a shroud enclosing a pumping chamber disposed between and connecting said beam tube and said beam port, said shroud having an exhaust port and collimating slits aligned with said beam tube and said beam port; and differential pumping means associated with said pumping chamber and communicating therewith through said exhaust port.

* * * * *